US008689595B2

(12) United States Patent
Martikainen

(10) Patent No.: US 8,689,595 B2
(45) Date of Patent: Apr. 8, 2014

(54) KEY AND DISC TUMBLER CYLINDER LOCK

(75) Inventor: Kaarlo Martikainen, Joensuu (FI)

(73) Assignee: Abloy Oy, Joensuu (FI)

( * ) Notice: Subject to any disclaimer, the term of this patent is extended or adjusted under 35 U.S.C. 154(b) by 646 days.

(21) Appl. No.: 12/305,631

(22) PCT Filed: Jun. 11, 2007

(86) PCT No.: PCT/FI2007/050340
§ 371 (c)(1),
(2), (4) Date: Dec. 18, 2008

(87) PCT Pub. No.: WO2007/147933
PCT Pub. Date: Dec. 27, 2007

(65) Prior Publication Data

US 2010/0212382 A1 Aug. 26, 2010

(30) Foreign Application Priority Data

Jun. 19, 2006 (FI) ..... 20065422

(51) Int. Cl.
*E05B 29/00* (2006.01)

(52) U.S. Cl.
USPC ..... 70/366; 70/375; 70/377

(58) Field of Classification Search
USPC ..... 70/357, 365, 366, 375, 377, 490
See application file for complete search history.

(56) References Cited

U.S. PATENT DOCUMENTS

| | | | | |
|---|---|---|---|---|
| 3,789,638 | A | 2/1974 | Ward et al. | |
| 4,127,996 | A | 12/1978 | Malminen et al. | |
| 4,336,700 | A * | 6/1982 | Baltscheffsky et al. | 70/366 |
| 4,351,172 | A | 9/1982 | Martikainen | |
| 4,637,240 | A * | 1/1987 | Nevalainen et al. | 70/366 |
| 5,131,248 | A * | 7/1992 | Ho | 70/366 |
| 5,490,405 | A * | 2/1996 | Ramo et al. | 70/366 |
| 6,003,351 | A * | 12/1999 | Chao et al. | 70/366 |
| 6,553,801 | B2 * | 4/2003 | Chen | 70/366 |
| 6,799,447 | B2 * | 10/2004 | Mielonen et al. | 70/366 |
| 6,854,305 | B2 * | 2/2005 | Hurskainen et al. | 70/278.3 |
| 6,860,127 | B2 * | 3/2005 | Chen | 70/38 A |
| 7,703,311 | B2 * | 4/2010 | Agbay | 70/366 |
| 2003/0019263 | A1 | 1/2003 | Chen | |
| 2005/0097932 | A1 * | 5/2005 | Ko | 70/366 |

FOREIGN PATENT DOCUMENTS

| | | |
|---|---|---|
| DE | 4404137 | 8/1995 |
| EP | 0617184 | 9/1994 |
| FI | 74320 | 9/1987 |
| FI | 94452 | 5/1995 |
| GB | 236625 | 7/1925 |
| GB | 2322404 A | 8/1998 |
| GB | 2339448 A | 1/2000 |

* cited by examiner

*Primary Examiner* — Christopher Boswell
(74) *Attorney, Agent, or Firm* — Muncy, Geissler, Olds & Lowe, P.C.

(57) ABSTRACT

The invention relates to a disc tumbler cylinder lock and a key for it. The key according to the invention comprises a groove that is transverse to the key shank. The groove comprises a bottom section and side sections that are transverse to the bottom section between the bottom section and the outer surface of the key shank. The bottom section of the groove is the key's main driving surface used to transfer turning force to the disc tumbler cylinder lock. This reduces wear on the O-surfaces of the key because the O-surfaces do not transfer the majority or any of the key turning force to the disc tumbler cylinder lock.

21 Claims, 6 Drawing Sheets

Figure 4:
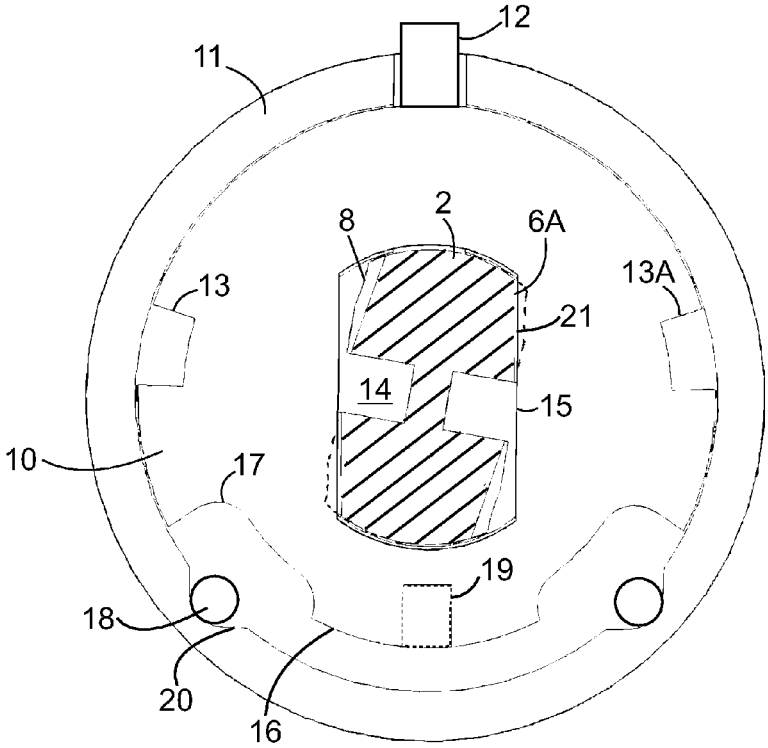

FIG. 1
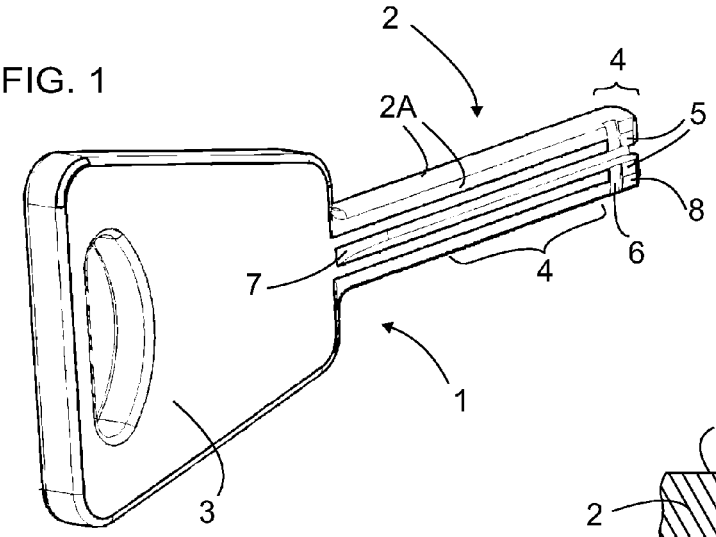
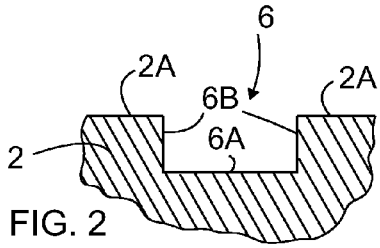
FIG. 2
FIG. 3
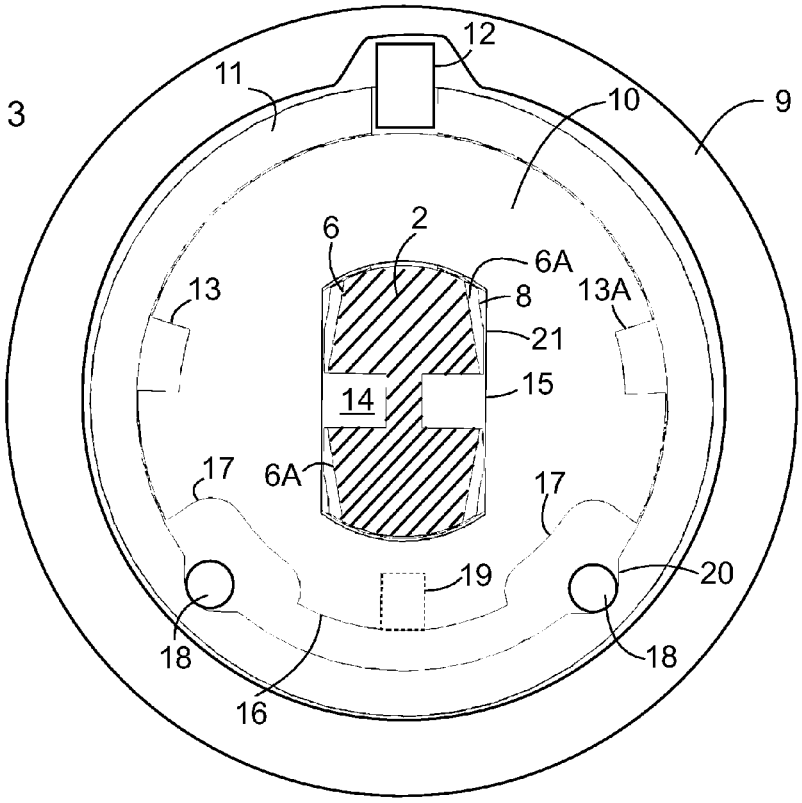

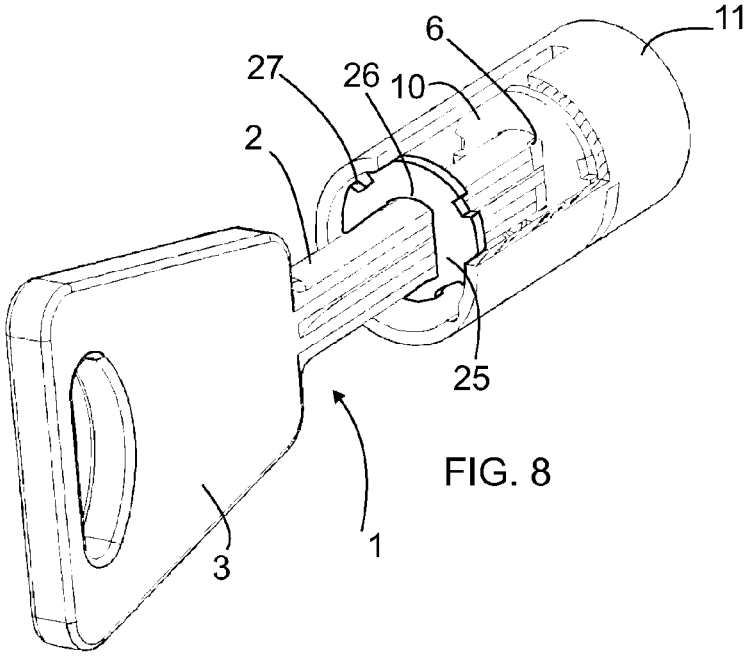
FIG. 8
FIG. 9
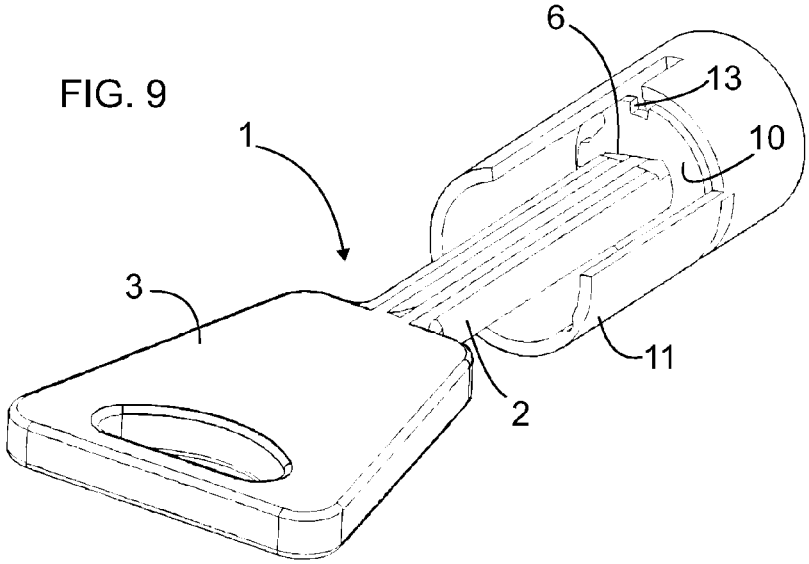

KEY AND DISC TUMBLER CYLINDER LOCK

This is a national stage application filed under 35 USC 371 based on International Application No. PCT/FI2007/050340 filed Jun. 11, 2007, and claims priority under 35 USC 119 of Finnish Patent Application No. 20065422 filed Jun. 19, 2006.

FIELD OF TECHNOLOGY

The invention relates to a cylinder lock and to its key. The invention particularly relates to a cylinder lock with disc tumblers—that is, a disc tumbler cylinder lock—and to its key.

PRIOR ART

In known disc tumbler cylinder locks, such as publication FI 74320, the tumblers are brought to the opening position by turning the key. Different combination surfaces have been cut onto the key, and when the key is turned, they guide the tumblers to turn to a position in which the recesses on the outer edge of the tumblers are aligned on a straight line. This allows the detent pin to move into the recesses in the tumblers, and the lock can be turned open.

The publication FI 74320 presents a key with four series of combination surfaces, allowing the key to be inserted into the corresponding cylinder in two positions (turning the key 180 degrees around its longitudinal axis). The publication FI 94452 presents another disc tumbler cylinder and its key. The key in this publication has two series of combination surfaces on opposite sides of the key profile—that is, the cross-section of the key shank.

The surfaces of keys wear in use. Wear on the surfaces impair the operation of the key and lock, which causes malfunctions and may further increase wear on the lock cylinder. The extreme outer surfaces of the key are particularly prone to wear caused by the environment. Furthermore, the surfaces used for turning the lock elements wear due to both the environment and resistance caused by the parts of the tumbler lock. The wearing of the key is quicker in heavier use, such as that of security guards, maintenance workers and caretakers.

SHORT DESCRIPTION OF INVENTION

The objective of the invention is to reduce problems due to wear on the key. The objective will be achieved as presented in the independent claims. The dependent claims describe various embodiments of the invention. The inventive idea aims to achieve the smallest possible wear on the surfaces of the key known as the 0-surfaces. 0-surfaces refer to the surfaces that are the outermost surfaces of the key shank and that have been arranged to operate with the parts of the disc tumbler cylinder lock every time the key is turned in the key channel of the lock. If the 0-surface is worn enough, it causes malfunction of the disc tumbler cylinder lock. Malfunctions can in turn impose additional wear on the lock parts.

The key according to the invention comprises a groove that is transverse to the key shank. The groove comprises a bottom section 6A and side sections 6B that are transverse to the bottom section between the bottom section and the outer surface 2A of the key shank. The bottom section of the groove is the key's main driving surface that is used to transfer turning force from the key to the disc tumbler cylinder lock. This reduces wear on the 0-surfaces of the key because the 0-surfaces do not transfer the majority or any of the force turning the key to the disc tumbler cylinder lock. Because the main driving surface that transfers the majority or the entire force turning the key to the inner cylinder of the cylinder lock is on the bottom of the groove 6, it is not very much exposed to wear caused by environmental factors. The wear on the key's driving surface 6A is practically entirely caused by contact between it and a transmission disc located in the inner cylinder of the lock.

LIST OF FIGURES

Figure 5:
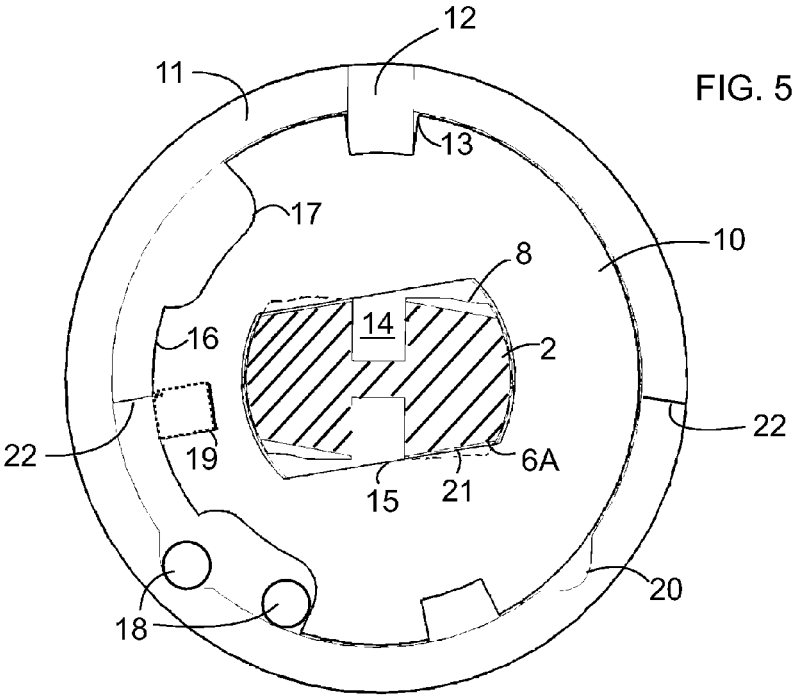
Figure 6:
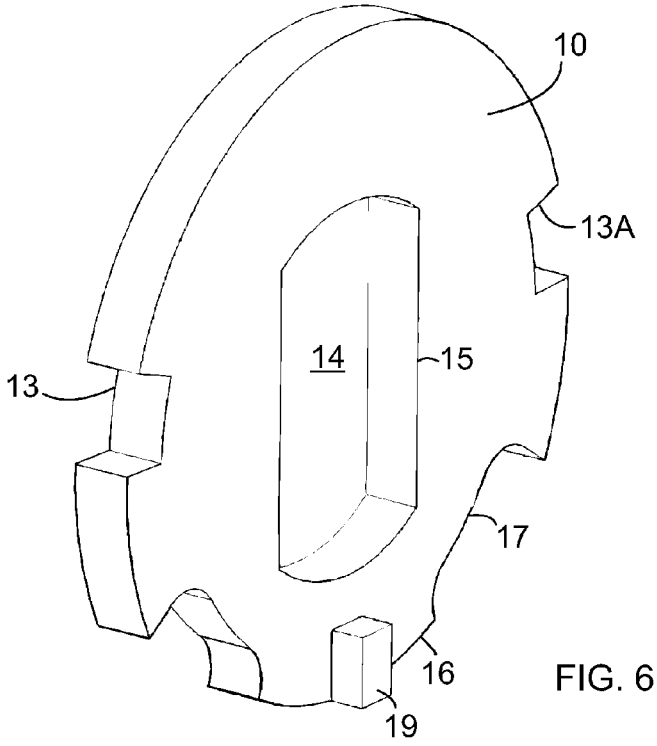
Figure 7:
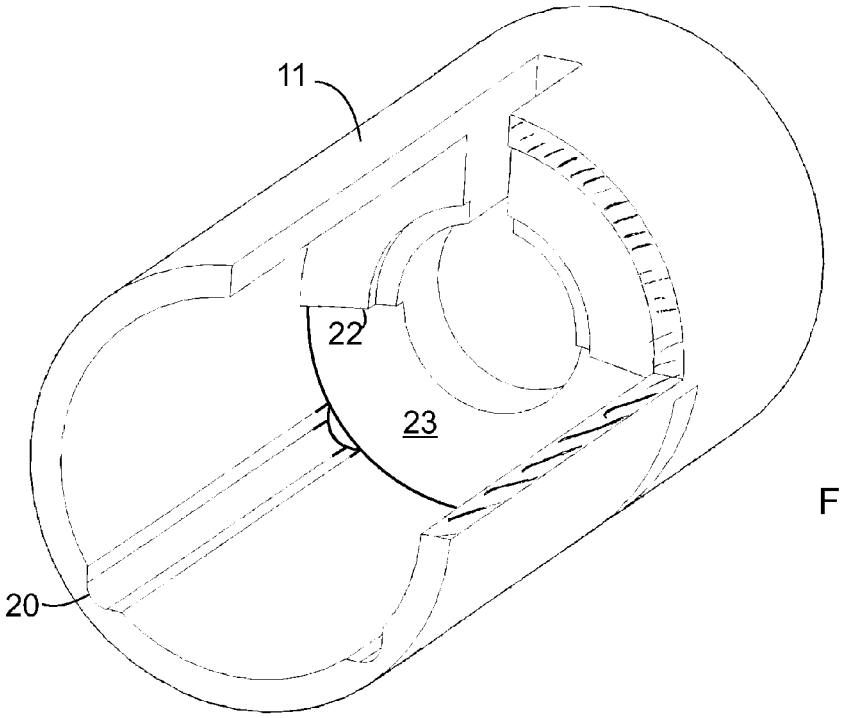
Figure 10:
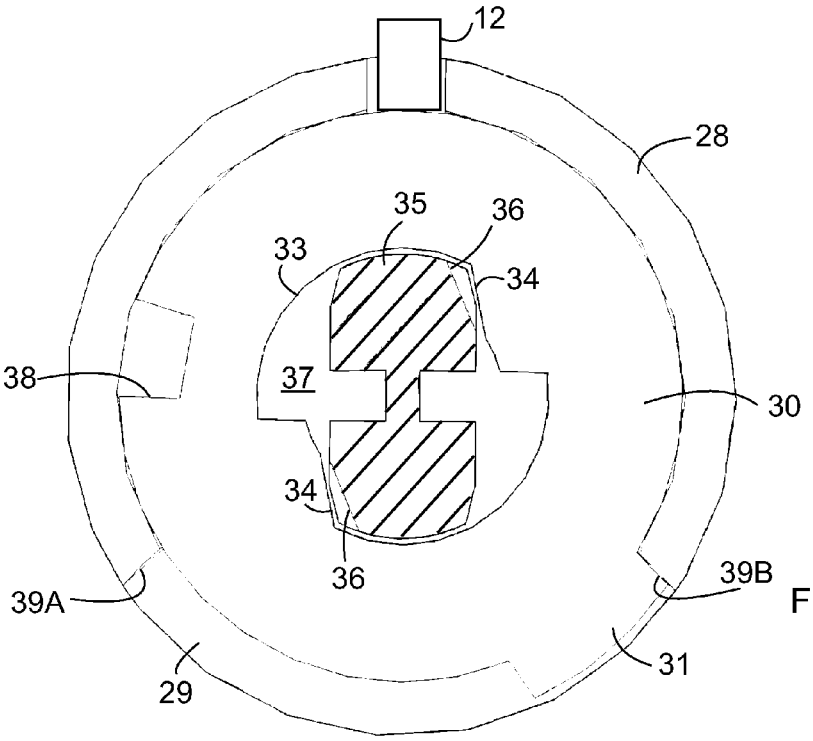
Figure 11:
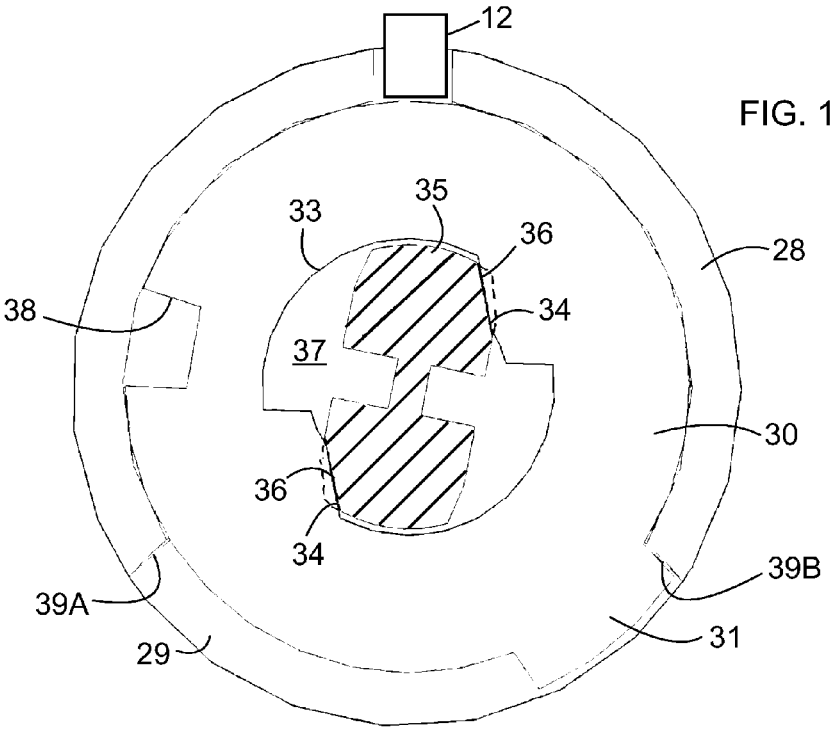
Figure 12:
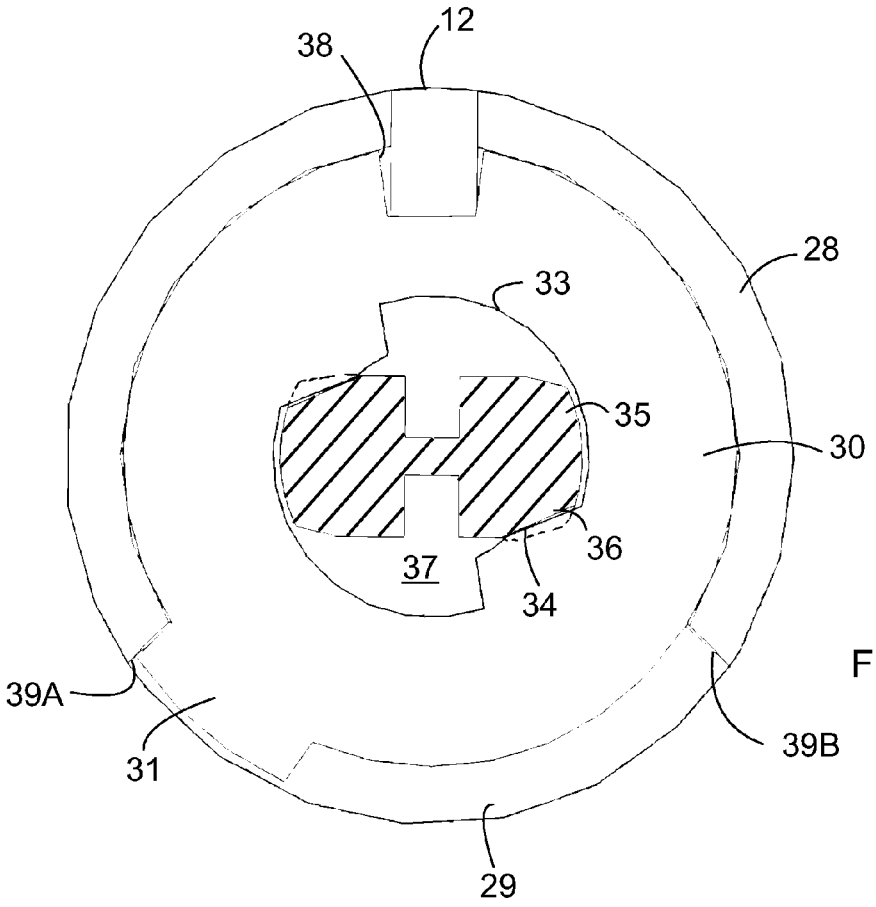

In the following, the invention is described in more detail by reference to the figures of the enclosed drawings, where FIG. 1 illustrates an example of a key according to the invention, FIG. 2 illustrates an example of a key groove according to the invention, FIG. 3 illustrates an example of a key and a transmission disc according to the invention with the key in the basic position, FIG. 4 illustrates an example of a key and a transmission disc according to the invention with the key turned against the transmission disc, FIG. 5 illustrates an example of a key and a transmission disc according to the invention with the key turned so that the transmission disc is against the mating surface in the inner cylinder of the lock, FIG. 6 illustrates an example of a transmission disc in a disc tumbler cylinder lock according to the invention, FIG. 7 illustrates an example of an inner cylinder in a disc tumbler cylinder lock according to the invention, FIG. 8 illustrates an example of a key and the parts of a disc tumbler cylinder lock according to the invention with the key in the basic position, FIG. 9 illustrates an example of a key and the parts of a disc tumbler cylinder lock according to the invention with the key turned, FIG. 10 illustrates another example of a key and a transmission disc according to the invention with the key in the basic position, FIG. 11 illustrates another example of a key and a transmission disc according to the invention with the key turned against the transmission disc, FIG. 12 illustrates another example of a key and a transmission disc according to the invention with the key turned so that the transmission disc is against the mating surface in the inner cylinder of the lock.

DESCRIPTION OF THE INVENTION

FIG. 1 illustrates an example of a key 1 according to the invention, more precisely a key blank on which a series of combination surfaces compatible with a particular disc tumbler cylinder lock has not yet been formed. (The blank can also operate as an actual key if the lock cylinder is arranged to operate with the blank.) The key shank 2 is turned using the end 3 of the key to open the disc tumbler cylinder lock. The shank 2 comprises a combination area 4 in the direction of the shank in which a series of combination surfaces can be established. The combination surfaces are cut onto the combination area. Usually these are referred to as the combination cuts. The example key in FIG. 1 has four combination areas. These are the short sides of the key shank profile and part of the ends of the long sides within a certain section of the length of the shank 2. The number of combination areas on the key shank depends on the key profile. However, the key shank comprises at least one combination area in the direction of the shank.

The shank 2 of the key 1 also comprises an outer surface 2A formed by the key blank and at least one groove 6 transverse to the direction of the shank. The groove comprises a bottom section 6A and side sections 6B that are transverse to the bottom section between the bottom section and the outer surface 2A of the shank. The bottom section 6A of the groove is the main driving surface through which turning force is transferable from the key 1 to the disc tumbler cylinder lock. The side sections 6B protect the bottom section 6A against wear caused by environmental factors. The groove 6 is illustrated in more detail in FIG. 2. When the bottom section 6A of the groove 6 has an even shape, it is easy to manufacture. It is preferred that the side sections 6B of the groove are at a right angle to the bottom section 6A. This way the groove 6 takes the least possible space on the key shank 2. Other shapes of the bottom section 6A and other transverse directions of the side sections against the axis of the key shank are also possible. In principle, the groove 6 can be placed in any appropriate location on the key shank. However, the recommended location is at the open end of the key shank as illustrated in FIG. 1. It is also possible that the groove 6 is (at least partially) in the combination area of the key shank.

The outer surface of the key also comprises the 0-surfaces 5 through which the force turning the key interacts with the 0-tumblers of the disc tumbler cylinder lock. The 0-tumblers always follow the turning of the key.

The combination area on the shank of a key according to the invention can optionally comprise a groove 8 parallel to the key shank, with the middle section of the groove being deeper than the edges of the groove. The groove 8 forms the lowest, i.e. the outermost, combination surfaces for the series of combination surfaces to be formed, so that the middle section of the groove forms a contact surface for the disc tumbler cylinder lock's tumbler. This is also aimed to reduce wear imposed on the outermost combination surfaces. The example key in FIG. 1 also comprises a rectangular groove 7 at the centre of the long sides of the key shank.

FIG. 3 illustrates an example of a key 1 and a disc tumbler cylinder lock according to the invention. FIG. 8 illustrates the inner cylinder of the lock in partial cross-section. The disc tumbler cylinder lock comprises a cylinder body 9 (shown in FIG. 3) and, within it, an inner cylinder 11. The inner cylinder has a stack of discs comprising tumblers 25 to be turned with the key 1 (FIG. 8). FIG. 8 only illustrates one of the tumblers in the stack of discs. At least one tumbler is a 0-tumbler. A 0-tumbler refers to a tumbler that always turns with the key and is intended to contact the outermost surface of the key, which is called the 0-surface. Correspondingly, reference is made to the 1-tumbler, 2-tumbler etc. depending on the correspondingly numbered surface of the combination surface that the tumbler is intended to contact. Different alternatives for the combination surface are created by cutting. The tumblers comprise a key channel 26 and an edge groove 27 at the outer edge of each tumbler. The cylinder lock also comprises a detent pin 12 for locking the lock. The detent pin can be arranged into the edge grooves 27 of the tumblers by turning the tumblers with the key 1 to open the lock.

It is clear that the disc tumbler cylinder lock normally also comprises other parts that are excluded from this description of the invention for the sake of clarity.

FIGS. 3 to 5 illustrate examples of the mutual operation of the key and the transmission disc of a disc tumbler cylinder lock according to the invention. The shank 2 of the key is illustrated in the direction of the shank axis, making the profile of the shank (the cross-sectional area of the key blank) visible. The cross-section of the key is at the groove 6. The inner cylinder 11 and the transmission disc 10 are viewed from the end of the axis of the inner cylinder. This also clearly shows the shape of the key channel 14 in the transmission disc.

FIG. 3 illustrates a key and a transmission disc according to the invention with the key in the basic position. The basic position refers to the key position in which the key can be inserted into the disc tumbler cylinder lock. The transmission disc 10 comprises a key channel 14 and an edge groove 13 on the outer edge of the disc. The edge 15 of the key channel comprises at least one mating surface 21 for the bottom section of the groove 6. The required number of mating surfaces depends on the key profile used. The mating surface is shaped to follow the shape of the bottom section of the groove 6. The cylinder lock also comprises a detent pin 12. The transmission disc also has a transmission element 19 that is arrangeable against a mating surface in the inner cylinder. FIG. 6 illustrates the transmission disc of the example in FIG. 1, and FIG. 7 illustrates the inner cylinder 11.

In the example of FIG. 3, the disc tumbler cylinder lock comprises two return pins 18 with the purpose of returning the tumblers in the stack within the inner cylinder to the basic position when the key is turned to the basic position after the lock is opened. The inner surface of the inner cylinder 11 has recesses 20 for the return pins. A disc tumbler cylinder lock of this type will thus open by turning the key in either direction. For this reason, the transmission disc in this type of a disc tumbler cylinder lock also has another edge groove 13A and an edge cutting 16 for the return pins 18. The ends of the edge cutting also have extended cutting areas 17.

FIG. 4 illustrates the example of FIG. 3 with the key turned against the transmission disc 10. The key profile of this example has four grooves 6. When the key is turned to open the lock, the bottom sections 6A of grooves on opposite surface sections of the key profile form a contact surface for the corresponding mating surfaces 21 of the edge 15 of the transmission disc's key channel. If the key is turned further clockwise from the situation of FIG. 4, the edge groove 13 on the transmission disc 10 can be turned to the position of the detent pin 12. Furthermore, when all of the tumblers in the stack within the inner cylinder 11 have been turned to the corresponding position, the detent pin is able to settle into the edge grooves of the tumblers and the transmission disc, making it possible to open the lock. In this situation, the key shank 2 is in the position shown in FIG. 5. In this position, the transmission element 19 on the transmission disc is in contact with the inner cylinder's mating surface 22, forming a transmission connection from the key 1 to the inner cylinder 11. When the key is turned further clockwise from the position of FIG. 5, the lock opens. The bottom section 6A of the groove is a driving surface from the key to the transmission disc.

FIG. 6 illustrates an embodiment of the transmission element 19 having a projection in the direction of the inner cylinder's axis. In other words, the projection is positioned transversely against the plane formed by the main surface of the transmission disc. FIG. 7 illustrates an embodiment of the inner cylinder 11 that accommodates the transmission element illustrated in FIG. 6. In this embodiment of the inner cylinder, the bottom of the inner cylinder has a movement area 23 for the transmission element 19. The movement area is a cutting on the inner bottom of the inner cylinder, and the edges of said cutting constitute mating surfaces 22 for the transmission element. Another alternative is that a cut recess is on the transmission disc and a projection is on the inner bottom of the inner cylinder, in which case the transmission element is either of the end edges of the cut recess and the movement area is the space remaining on the sides of the projection. The mating surfaces are the sides of the projection that are located transversely against the circumference of the transmission disc.

It can be seen from FIGS. 2 to 5 that the bottom section 6A of the groove is even, and this is also the case with the mating surfaces 21 of the transmission disc. An even shape of the mating surface is preferred because it forms an even and extensive contact surface for the key's main driving surface and is easy to manufacture. Other shapes are naturally possible but also in this case it must be observed that the contact shape created is as extensive as possible. Furthermore, it can be seen that the groove can have different depths in relation to the outer surface 2A of the key at different points of the bottom section 6A in the longitudinal direction of the groove. This feature aims to create an extensive contact surface.

FIG. 8 illustrates a key 1 according to the invention and the parts of the inner cylinder 11 when the key is in normal position in the key channel of the disc tumbler cylinder lock. FIG. 9 illustrates a situation in which the key has been turned so that the edge groove 13 of the transmission disc 10 (and simultaneously the edge grooves 27 of the tumblers 25) are aligned in line at the detent pin.

FIG. 10 illustrates another example of a key and a transmission disc 30 according to the invention with the key shank 35 in the basic position. In this example, the key has two transverse grooves, the bottom sections 36 of which can be arranged against the mating surface 34 of the edge 33 of the key channel 37 of the transmission disc 30. In addition to the edge groove 38, the edge of the transmission disc has a radial projection that constitutes the transmission element 31.

The movement area 29 of the transmission element is a cutting on the wall of the inner cylinder, and the edges 39A, 39B of the cutting constitute mating surfaces for the transmission element 31. The projection is arranged to be in contact with one of the mating surfaces 39A when the key is turned to open the lock so that the edge groove 38 of the transmission disc is at the detent pin 12 and so that the edge groove of the 0-tumbler within the stack of tumblers is arranged to turn to the position of the detent pin 12 at the same time the edge groove 38 of the transmission disc turns to the position of the detent pin. The edge grooves of the other tumblers have also been arranged to simultaneously turn to the position of the detent pin. The lock in this example can only be opened by turning the key in one direction.

FIG. 11 illustrates the example of FIG. 10 with the key turned against the transmission disc 30. When the key is turned to open the lock, the bottom sections 36 of grooves on opposite surface sections of the key profile form a contact surface for the corresponding mating surfaces 34 of the edge 33 of the transmission disc's key channel. If the key is turned further clockwise from the situation of FIG. 11, the edge groove 38 on the transmission disc 30 can be turned to the position of the detent pin 12. Furthermore, when all of the tumblers in the stack within the inner cylinder 11 have been turned to the corresponding position, the detent pin is able to settle into the edge grooves of the tumblers and the transmission disc, making it possible to open the lock. In this situation, the key shank 35 is in the position shown in FIG. 12. In this position, the transmission element 31 on the transmission disc is in contact with the inner cylinder's mating surface 39A, forming a transmission connection from the key 1 to the inner cylinder 28. When the key is turned further clockwise from the position of FIG. 12, the lock opens. When the key is turned counter-clockwise again, the detent pin 12 is allowed to rise out of the edge grooves with the help of a spring arrangement in the cylinder lock. At this time the lock returns to the locked state. One of the sides of the edge groove 38 in the transmission disc (in the figure, the right side of the groove in relation to the centre of the disc) can also be inclined in order to facilitate the detent pin rising from the groove 38.

As illustrated by the examples, in a key/lock combination according to the invention, the main transmission of force—that is, the transmission of the majority or the entire force from the key to the lock cylinder—takes place through the bottom section 6A of the transverse groove 6 in the key shank. The edges 6B of the groove protect the bottom section from external wear caused by environmental factors. Because there is no transmission of force (mainly or not at all) through the 0-surfaces of the key, the wear imposed on them is reduced in comparison to previous implementations in which the 0-surfaces were involved in the transmission of force from the key to the lock cylinder. However, the operation between the transmission groove 6 and the lock cylinder should be arranged so that the 0-surfaces of the key are still utilised, for example for guiding the return pins and as a possible combination alternative. Thus the edge grooves of the tumblers and the transmission disc must be aligned in line at the detent pin to open the lock. The tumbler(s) can be arranged so that they do not transfer force between the key and the inner cylinder of the lock cylinder, or so that only a small share of the total force turning the key is transferred through the tumbler or tumblers.

A key according to the invention can be implemented for different profiles of a key for a disc tumbler cylinder lock, for example so that the basic shape of the profile of the key shank 2 (the key blank profile) is a rectangle having long sides and short sides, the short sides being rounded to form convex surfaces. Another example is that the basic shape of the profile of the key shank 2 is a rectangle having long sides and short sides, two opposite corners of the rectangle being rounded. There may also be a rectangular groove 7 in the middle of the long sides of said example profiles.

It is evident from the examples presented above that an embodiment of the invention can be created using a variety of different solutions. It is also evident that the invention is not limited to the examples mentioned in this text but can be implemented in many other different embodiments within the scope of the inventive idea.

The invention claimed is:

1. A disc tumbler cylinder lock and key combination, the lock comprising a cylinder body and within it an inner cylinder, the inner cylinder containing a stack of tumblers that comprises tumblers to be turned relative to the inner cylinder with a key, at least one of the tumblers being a 0-tumbler, said tumblers each being formed with a key channel and with an edge groove at the outer edge of the tumbler, and said cylinder lock also comprising a detent pin for locking the lock, said detent pin being able to be arranged into the edge grooves of the tumblers by turning the tumblers with the key to the position of the detent pin for opening the lock, the key comprising a shank having an outer surface formed by the key blank and at least one combination area in the direction of the shank, in which area a series of combination surfaces is establishable, wherein the shank also comprises at least one groove transverse to the shank direction, said groove comprising a bottom section and side sections transverse to the bottom section between the bottom section and the outer surface of the shank, and the bottom section of the groove being a main driving surface through which force turning the key is transferable to the inner cylinder of the disc tumbler cylinder lock, the stack of tumblers also comprises a transmission disc defining a key channel, the edge of which comprises a mating surface for the main driving surface of the key, and an edge groove at the outer edge of the transmission disc, the transmission disc comprising a transmission element disposed on the transmission disc, the edge groove and the transmission element being disposed at different positions on the transmission disc, and the inner cylinder defines a movement area for the transmission element and mating surfaces at the ends of the movement area to transmit three turning the transmission disc to the inner cylinder, the transmission disc being turnable by the key relative to the inner cylinder to a position for opening the lock in which the edge groove of said transmission disc is aligned with the edge grooves of the tumblers at the position of the detent pin so that the detent pin is able to settle into the aligned edge grooves, and the transmission element engages a mating surface of the inner cylinder when turning the key for opening lock.

2. A disc tumbler cylinder lock and key combination according to claim 1, wherein the mating surface of the transmission disc is even and forms an even contact surface for the main driving surface of the key.

3. A disc tumbler cylinder lock and key combination according to claim 1, wherein the transmission element is a projection in the direction of the inner cylinder's axis and the movement area for the transmission element is a cutting on the bottom of the inner cylinder, the edges of said cutting constituting mating surfaces for the transmission element.

4. A disc tumbler cylinder lock and key combination according to claim 3, wherein the cylinder lock comprises return pins and the tumblers have a second edge groove.

5. A disc tumbler cylinder lock and key combination according to claim 1, wherein the transmission element is a radial projection on the edge of the transmission disc and the movement area for the transmission element is a cutting on the wall of the inner cylinder, the edges of the cutting constituting mating surfaces for the transmission element, said projection being arranged to engage one of the mating surfaces when the key is turned for opening the lock so that the edge groove of the transmission disc is at the position of the detent pin and so that the edge groove of the 0-tumbler within the stack of tumblers turns to the position of the detent pin at the same time the edge groove of the transmission disc turns to the position of the detent pin.

6. A disc tumbler cylinder lock and key combination according to claim 1, wherein the transmission disc comprises a cut recess and a projection is on the inner bottom of the inner cylinder, and the transmission element is either of the end edges of the cut recess and the movement area is the space remaining on the sides of the projection, the mating surfaces being the sides of the projection that are located transversely against the circumference of the transmission disc.

7. A disc tumbler cylinder lock and key combination according to claim 1, wherein the bottom section of the groove has an even shape.

8. A disc tumbler cylinder lock and key combination according to claim 7, wherein the side sections of the groove are at a right angle to the bottom section.

9. A disc tumbler cylinder lock and key combination according to claim 7, wherein the bottom section of the groove has different depths in relation to the outer surface at different points of the groove in the longitudinal direction of the groove.

10. A disc tumbler cylinder lock and key combination according to claim 1, wherein the groove is at the open end of the key shank.

11. A disc tumbler cylinder lock and key combination according to claim 1, wherein the groove is within the combination area of the key shank.

12. A disc tumbler cylinder lock and key combination according to claim 1, wherein the combination area comprises a groove parallel to the key shank, with the middle section of the groove being deeper than the edge sections of the groove, and said groove forms the outermost combination surfaces for the series of combination surfaces to be formed, so that the middle section of the groove forms a contact surface for the disc tumbler cylinder lock's tumbler.

13. A disc tumbler cylinder lock and key combination according to claim 1, wherein the basic shape of the profile of the key shank is a rectangle having long sides and short sides, the short sides being rounded to form convex surfaces.

14. A disc tumbler cylinder lock and key combination according to claim 1, wherein the basic shape of the profile of the key shank is a rectangle having long sides and short sides, two opposite corners of the rectangle being rounded.

15. A disc tumbler cylinder lock and key combination according to claim 1, wherein the basic shape of the profile of the key shank is a rectangle having long sides and short sides, and there is a rectangular groove in the middle of the long sides.

16. A disc tumbler cylinder lock and key combination according to claim 1, wherein the transmission element is a projection extending from a surface of the transmission disc.

17. A disc tumbler cylinder lock and key combination according to claim 16, wherein the projection is positioned transversely against a plane formed by a main surface of the disc.

18. A disc tumbler cylinder lock and key combination according to claim 1, wherein the edge groove of the transmission disc is configured to engage the detent pin of the cylinder lock.

19. A disc tumbler cylinder lock and key combination according to claim 1, wherein the edge groove of the transmission disc is configured to receive the detent pin of the cylinder lock.

20. A disc tumbler cylinder lock and key combination according to claim 1, wherein the edge groove and the transmission element are spaced apart on different sides of the transmission disc.

21. A disc tumbler cylinder lock and key combination according to claim 1, wherein the transmission disc drives the inner cylinder directly.

* * * * *